US009037029B2

(12) United States Patent
Toriyabe

(10) Patent No.: US 9,037,029 B2
(45) Date of Patent: May 19, 2015

(54) JOB CONTROL APPARATUS AND METHOD, AND RECORDING MEDIUM FOR PRODUCING A BOOK

(75) Inventor: Hiroyuki Toriyabe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 497 days.

(21) Appl. No.: 13/453,041

(22) Filed: Apr. 23, 2012

(65) Prior Publication Data

US 2012/0288298 A1 Nov. 15, 2012

(30) Foreign Application Priority Data

May 12, 2011 (JP) ..... 2011-107289

(51) Int. Cl.

| | |
|---|---|
| ***B65H 39/02*** | (2006.01) |
| ***G03G 15/00*** | (2006.01) |
| *B65H 39/06* | (2006.01) |
| *B65H 39/00* | (2006.01) |

(52) U.S. Cl.

CPC ..... *G03G 15/5083* (2013.01); *G03G 15/6538* (2013.01); *G03G 15/6544* (2013.01); *B65H 39/06* (2013.01); *B65H 39/02* (2013.01); *B65H 2801/31* (2013.01); *B65H 2801/27* (2013.01); *B65H 39/00* (2013.01)

(58) Field of Classification Search

CPC ..... G03G 15/5083; B65H 2801/31
USPC ..... 399/82, 362; 412/11, 18; 270/52.04, 270/52.05, 52.06

See application file for complete search history.

(56) References Cited

U.S. PATENT DOCUMENTS

| | | | | |
|---|---|---|---|---|
| 4,674,052 | A * | 6/1987 | Wong et al. | 705/402 |
| 6,152,439 | A * | 11/2000 | Hirayama et al. | 270/52.04 |
| 6,246,993 | B1 * | 6/2001 | Dreyer et al. | 705/7.26 |
| 7,198,260 | B2 * | 4/2007 | Huber et al. | 270/52.04 |
| 7,454,163 | B2 * | 11/2008 | Kasahara et al. | 399/408 |
| 8,068,238 | B2 | 11/2011 | Kuroshima | |
| 8,840,351 | B2 * | 9/2014 | Adler et al. | 412/11 |
| 8,919,758 | B2 * | 12/2014 | Mueller | 270/52.02 |
| 2002/0018235 | A1 * | 2/2002 | Ryan et al. | 358/1.15 |
| 2006/0028662 | A1 * | 2/2006 | Dobrovolsky | 358/1.9 |
| 2008/0229940 | A1 * | 9/2008 | Levin et al. | 101/2 |
| 2008/0291481 | A1 * | 11/2008 | Haller | 358/1.13 |
| 2009/0278308 | A1 * | 11/2009 | Toriyabe et al. | 271/298 |
| 2012/0176645 | A1 * | 7/2012 | Saito | 358/1.15 |

* cited by examiner

*Primary Examiner* — David Gray
*Assistant Examiner* — Geoffrey Evans
(74) *Attorney, Agent, or Firm* — Carter, DeLuca, Farrell & Schmidt, LLP

(57) ABSTRACT

There is provided an error recovering method that can be applied to a photobook production flow handling plural types of parts and reduces operator's manual workload while keeping consistency in the job order between the plurality of parts at the time of occurrence of an error. An information processor receives information on an error that is caused in a printer or a post-apparatus and determines whether or not reprinting of a target part is necessary. When determining that reprinting is necessary, the information processor updates job tickets of an error-caused part and other types of parts and transmits the updated job tickets to the printer and the post-apparatus. The printer and the post-apparatus execute post-processing in accordance with the job tickets updated by the information processor.

9 Claims, 23 Drawing Sheets

600

```
<?xml version="1.0" encoding="utf-8"?>
<JDF ID="J1"
 JobPartID="ID0" Types="DigitalPrinting"
 Status="Ready"
  xmlns="http://www.CIP4.org/JDFSchema_1_1"
xmlns:cj="http://www.hogehoge.com/ns/HogehogeJDF"
 DescriptiveName="cover_1234"
 JobID="123401 "
                    601
 Error Flag= "1" >
                    604
<ResourcePool>
 <RunList Class="Parameter" ID="IDRL" Status="Available" PartIDKeys="Run">
  <RunList Run="0" Pages="0~0" NPage="1">
   <LayoutElement>
    <FileSpec URL="cover_1234.pdf" />
   </LayoutElement>
  </RunList>
 </RunList>

 <DigitalPrintingParams Class="Parameter" ID="IDDPP" Status="Available" OutputBin="Tray-2">
  <MediaRef rRef="RES_000" />
 </DigitalPrintingParams>
 <Component Class="Quantity" ID="IDC" ComponentType="FinalProduct" Status="Unavailable" />
 <Media ID="RES_000" Class="Consumable" Status="Available" Dimension= "612 792">
  <Location LocationName="Tray-1" />
 </Media>
</ResourcePool>                                   602

<ResourceLinkPool>
 <RunListLink rRef="IDRL" Usage="Input" CombinedProcessIndex="0 1" />
 <DigitalPrintingParamsLink rRef="IDDPP" Usage="Input" CombinedProcessIndex="4" />
 <ComponentLink rRef="IDC" Usage="Output" CombinedProcessIndex="4 " Amount= "3" />
<MediaLink Usage="Input" rRef="RES_000" CombinedProcessIndex="4" />
</ResourceLinkPool>                                603
</JDF>
```

FIG.6

1001

| | COVER | BODY | STRIP | JACKET |
|---|---|---|---|---|
| PROCESS 1 | PRINTING | PRINTING | PRINTING | PRINTING |
| PROCESS 2 | CASE BINDING | CASE BINDING | CREASING | CREASING |
| PROCESS 3 | CUTTING | CUTTING | ASSEMBLING | ASSEMBLING |
| PROCESS 4 | ASSEMBLING | ASSEMBLING | | |

PROCESS ORDER INFORMATION

FIG.10A

1002

| | | OTHER PARTS | | | |
|---|---|---|---|---|---|
| | | COVER | BODY | STRIP | JACKET |
| TARGET PART | COVER | – | CASE BINDING | ASSEMBLING | ASSEMBLING |
| | BODY | CASE BINDING | – | ASSEMBLING | ASSEMBLING |
| | STRIP | ASSEMBLING | ASSEMBLING | – | – |
| | JACKET | ASSEMBLING | ASSEMBLING | ASSEMBLING | – |

MERGING PROCESS INFORMATION

FIG.10B

ORDER IS CHANGED DUE TO ERROR.
PROCESS THIS PART LAST.

OK

FIG.19

JOB CONTROL APPARATUS AND METHOD, AND RECORDING MEDIUM FOR PRODUCING A BOOK

BACKGROUND OF THE INVENTION

1. Field of the Invention

The present invention relates to job control apparatus and method, and a recording medium.

2. Description of the Related Art

Conventionally, there has been provided a so-called photobook order service in which the user can freely arrange image data in a layout having a plurality of pages on a personal computer to produce a book and order the book. A photobook is often constituted by a plurality of parts such as a body, a cover, a jacket and a strip. In a process of actually producing the photobook, these parts are subjected to different post-processing processes after printing. For this reason, each of the post-processing processes of the parts are generally executed by a different post-processor. Therefore, when an order of the plurality of photobooks is issued, in order to save the effort of assortment in transporting printed matters to the post-processors, if is necessary to perform printing for each batch of the same parts and feed the printed matters to the post-processor as they are, for post-processing.

At this time, the parts in a batch are stacked in a predetermined order designated by a photobook production system, and the order is common to all types of parts. This is performed in order to keep consistency in combining the plural types of parts constituting the identical ordered product and binding a book.

Furthermore, when an error is caused in the working process, the operator needs to carry our, a so-called recovery operation in order to perform printing and post-processing of the parts in the photobook which pass through printing and a plurality of post-processing processes, again.

In the recovery operation, in order to keep consistency in the same order job, the operator has to match the order of the error-caused part and the order of other parts in the batch. Two common methods are considered for order matching.

In accordance with one method, the operation of a subsequent job is temporarily stopped at the time of occurrence of the error, and then the operation is restarted after performing the recovery processing of the target part. In this case, the order initially designated by the photobook production system is maintained.

In accordance with another method, the subsequent job is first completed while leaving the recovery operation for the error-caused part later, and the recovery operation is finally performed. In this case, for example, by moving the error-caused part to the tail end of the batch, the original part order is changed.

In the former case, the process of the error-caused part, and in some cases, the operation of other types of parts are stopped and priority on the recovery operation is placed. Accordingly, from the viewpoint, of overall productivity, the latter method is more preferable. However, in the latter case, the operator's manual operation for keeping consistency in the order between the parts is necessary. Specifically, the order of all of other types of parts is manually changed to the same order of the error-caused part. At this time, the operator has to visually check other types of parts constituting the same order as the error-caused part and move the parts in the same order as the error-caused part (for example, to the tail end).

In a photobook production site, there is a high demand for a method of recovering an error while reducing such operator's workload. Japanese Patent laid-Open No. 2006-309319 discloses an error recovery technique. According to the technique described in Japanese Patent laid-Open No. 2006-309319, when a certain error is caused in a working process, first, it is determined whether or not change in the working process described in a job ticket, (print, setting information, or post-processing setting information) is necessary. When it is determined that change is necessary, according to the technique described in Japanese Patent laid-Open No. 2006-309319, another device that can implement the target, working process is searched, and a new job ticket is generated to cause the device to perform the operation.

However, in Japanese Patent laid-Open No. 2006-30.931.9, the job ticket is updated noting only a single job and therefore, it is hard to say that the technique can be applied, to a photobook production flow of dealing with plural types of parts in parallel. In other words, although the technique can address recovery of the error-caused part itself, it does not give consideration to other parts constituting the same order.

Furthermore, Japanese Patent laid-Open No. 2006-309319 does not note a workflow in the actual photobook production site of executing processing for each batch of the same parts in response to a plurality of orders. That is, the processing of keeping consistency in the job order of a plurality of parts is not disclosed.

SUMMARY OF THE INVENTION

An object of the present invention is to provide an apparatus, a method and a recording medium which can be applied to a photobook production flow for a plurality of orders of a photobook handling plural types of parts and which reduce operator's manual workload while achieving high productivity.

An apparatus according to the present invention is an apparatus that controls a plurality of jobs performed in a printer and a post-processor to produce a book including a plurality of parts, including a unit configured to receive information on an error that is caused in the printer or the post-processor, a unit configured to determine whether or not reprinting of the part is necessary on the basis of the received error information, and a unit configured to inform the printer and the post-processor of change in the job order of the part determined that the reprinting is necessary and change in the job order of another part that constitutes the same book as the part determined that the reprinting is necessary.

According to the present invention, it is possible to provide an apparatus, a method and a recording medium which can be applied to a photobook production flow for a plurality of orders of a photobook handling plural types of parts and which reduce operator's manual workload while achieving high productivity.

Further features of the present invention will become apparent from the following description of exemplary embodiments (with reference to the attached drawings).

BRIEF DESCRIPTION OF THE DRAWINGS

FIG. 6 is a diagram showing an example of description of data;

FIGS. 10A and 10B are showing an example, of process information held in an information processor;

FIG. 19 is a diagram showing an example of an UI that informs the operator of change in the order of the part in Example 1;

DESCRIPTION OF THE EMBODIMENTS

Best modes for carrying out the present invention will be described with reference to figures. However, constituents described in this embodiment are merely examples and the scope of the present invention is not limited to these.

[First Embodiment]

Figure 1:
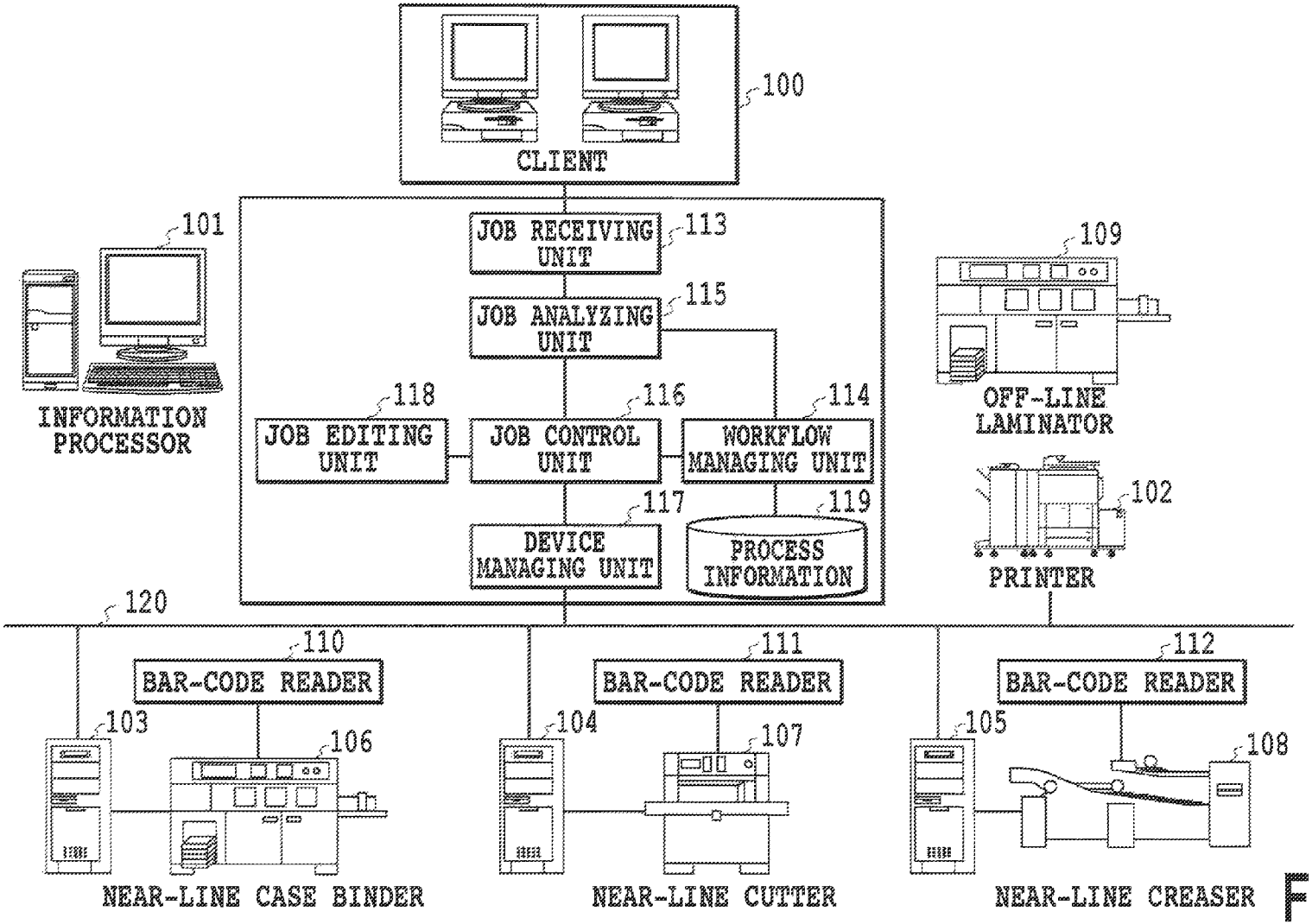
FIG. 1 is a block diagram showing an overall configuration of a system according to an embodiment.

FIG. 1 is a view showing an example of a configuration of a system that produces a case binding product according to the present invention.

The present system includes an information processor 101 and a printer 102. The present system further includes a near-line case binder 106, a near-line cutter 107, a near-line creaser 108 and an off-line laminator 109 as post-processors (finishers, or post-apparatuses). The present system further includes post-processing controllers (finisher controllers) 103 to 105 that control the near-line case binder 106, the near-line cutter 107 and the near-line creaser 108, respectively. The present system further includes bar-code readers 110 to 112 that operate on the near-line case binder 106, the near-line cutter 107 and the near-line creaser 108. In this embodiment, although the post-processors 106 to 108 are separated from the post-processing controllers 103 to 105, respectively, the present invention is not limited to this. The post-processors 106 to 108 may include the finisher controllers 103 to 105 therein, respectively. The constituents of the present system are connected to one another via a network 120.

The information processor 101 is constituted by a job receiving unit 113, a workflow managing unit 114, a job analyzing unit 115, a job control unit 116, a device managing unit 117, a job editing unit 118 and a process information 119. The printer 102 interprets a printing job transmitted through the device managing unit 117, and performs rasterizing and printing. The job receiving unit 113 receives data on printing job and post-processing job from a client 100. The workflow managing unit 114 manages data, on a post-processing workflow preset by the user. The received data is stored and managed in the process information 119. The job analyzing unit 115 analyzes the job received through the job receiving unit 113, acquires detailed information on contents, detailed print setting information or post-processing setting information and stores the information in a memory. The job control unit 116 controls outputting of the job analyzed by the job analyzing unit 115 on the basis of the process information 119 managed by the workflow managing unit 114. The device managing unit 117 manages the printer 102 and the post-processors (106 to 108). The device managing unit 117 has a function of acquiring capability information (performance information), configuration information and printer connection information from the printer 102 and the post-processors (106 to 108) and a function of transmitting the printing job to the printer 102 and the post-processing job to the post-processors (106 to 108). The information processor 101 holds the process information 119. Details of the process information 119 will be described, later with reference to FIGS. 10A and 10B. The job editing unit 118 has a function of editing the contents in the job or the job ticket.

Figure 3:
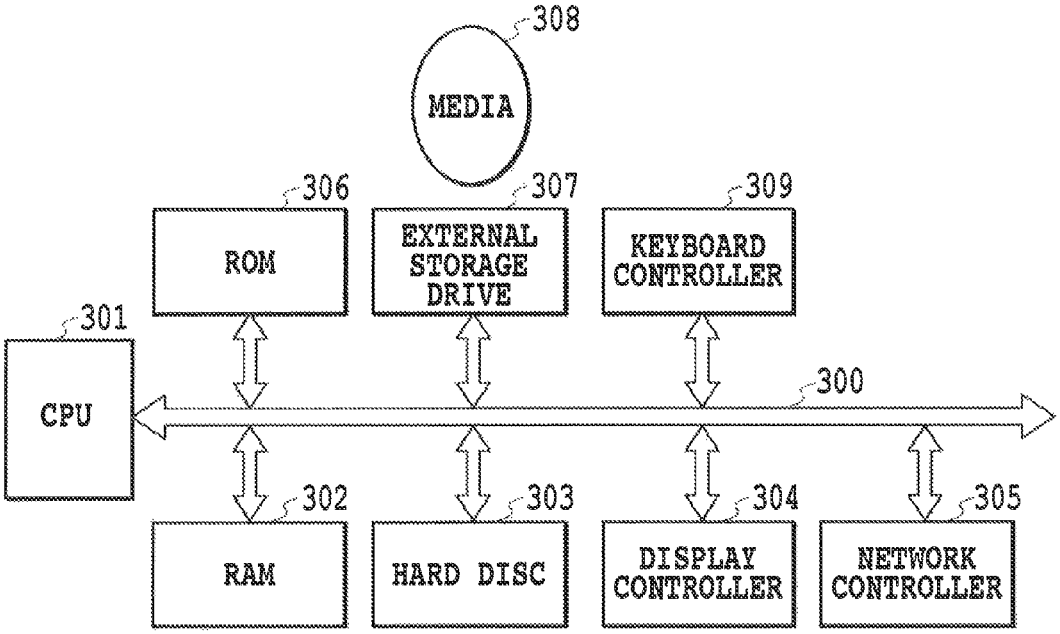
FIG. 3 is a block diagram showing an example of an inner configuration of an information processor.

FIG. 3 is a block diagram showing an example of an inner configuration of the information processor 101. A CPU 301 executes programs stored in a program area in a ROM 306 or programs such as OS and general-purpose applications loaded from a hard disc 303 into a RAM 302. The RAM 302 functions as a main memory of the CPU 301, a work area or the like. The hard disc 303 stores boot programs, various applications, font data, user files, electronic manuscript files and so on therein. All printing jobs received by the information processor 101 are sent to the hard disc 303. A display controller 304 controls displaying on a display. A network controller 305 executes communication control processing with other devices connected to the network. A keyboard controller 309 controls key inputting from a keyboard and a pointing device. The CPU 301 is connected to each block via an internal bus 300.

Figure 2:
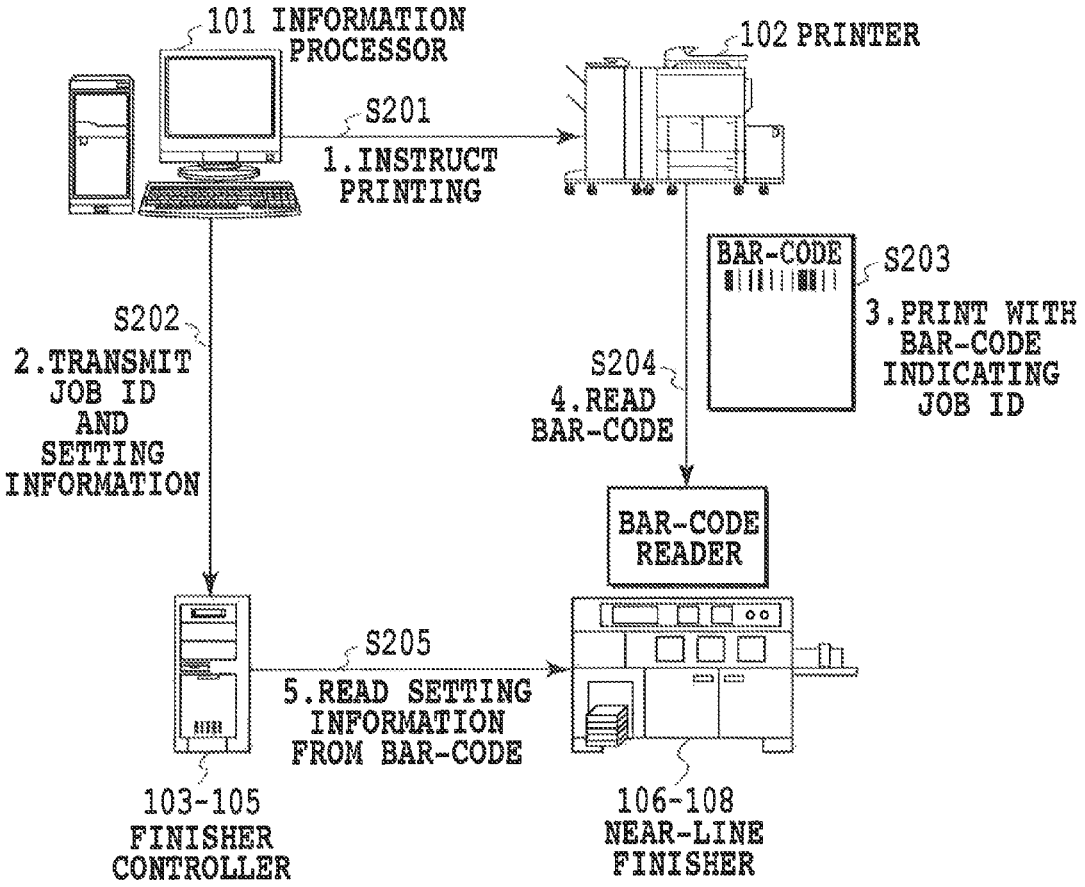
FIG. 2 is a diagram showing processing of the system in FIG. 1 in detail.

FIG. 2 shows processing flow of the information processor 101, the printer 102, the finisher controller 103, the bar-code reader 110 and the near-line case binder 106 in FIG. 1 in more detail.

The information processor 101 controls a plurality of jobs executed by the printer 102 and the finishers (post-processors) 106, 107, 108 to produce a book such as a photobook including a plurality of parts.

Here, using the near-line case binder 106 as an example, the processing flow of the finisher controller 103 and the bar-code reader 110 will be described. As to the whole processing flow, the same description also applies to the other finishers and the finisher controllers connected thereto.

In FIG. 2, first, the information processor 101 transmits the job ticket (print setting information and job ID information) to the printer 102 and issues an instruction to print contents data (S201).

Next, the information processor 101 transmits the job ticket (post-processing setting information and job ID information) for operating the near-line case binder 106 to the finisher controller 103 (S202). The post-processing setting information is associated with the simultaneously transmitted job ID information and is stored in the finisher controller 103. As described above, when the finisher includes the finisher controller, the information processor 101 transmits the job ticket to the near-line case binder ICS. The same applies to examples described later.

Next, the printer 102 prints each part. Then, the job ID information corresponding to the each printed part, which is transmitted to the printer 102 in S201, is printed as a bar-code (S203).

The information processor 101 assigns a job ID so that parts constituting the same order (the cover, the body, the strip, the jacket, etc.) are tied together. For example, a common order ID may be embedded in the job ID of the parts constituting the same order. Using a description example 600 of xml data on the print setting information and the post-processing setting information in FIG. 6 as a specific example, a sequence of the first four digits "1234" of a sequence "123401" defined as the job ID 601 may be used as the order ID. That is, the sequence of the first four digits of the job ID assigned to all parts constituting the same order as the parts targeted by the xml data is "1234" at all times.

The operator who produces a case binding product transports the print outputted in S203 to the near-line, case binder 106 and reads the printed bar-code (indicating the job ID) by use of the bar-code reader 110 (S204).

The job ID read by the bar-code reader is compared with the job ID transmitted to the finisher controller 103 in S202, and the post-processing setting information transmitted in S202 is loaded into the near-line case binder 106 (S205). Post-processing is executed according to the post-processing setting information.

The job ID reading processing of the bar-code reader is used to load setting of post-processing as well as confirm consistency in a plurality of parts. For example, the near-line case binder 106 processes the two types of parts: the cover and the body, and at this time, when the common order ID of the cover is different from the common order ID, the product is unusable and printing and post-processing has to be performed again. In order to prevent such situation, confirmation of consistency in the parts on the basis of the bar-code is an important operation.

In order to meet consistency in a plurality of parts constituting the same order, even in an assembling process using no finishers (106 to 108), a configuration in which the operator is caused to execute the job ID reading processing on the basis of the bar-code reader, can also be considered an embodiment. In this case, a controller for the assembling process and a bar-code reader connected to the controller are added to the system configuration shown in FIG. 1. The controller for the assembling process is connected to the information processor 101 via the network 120, and can transmit and receive various information on the job to and from the information processor 101.

Figure 4B:
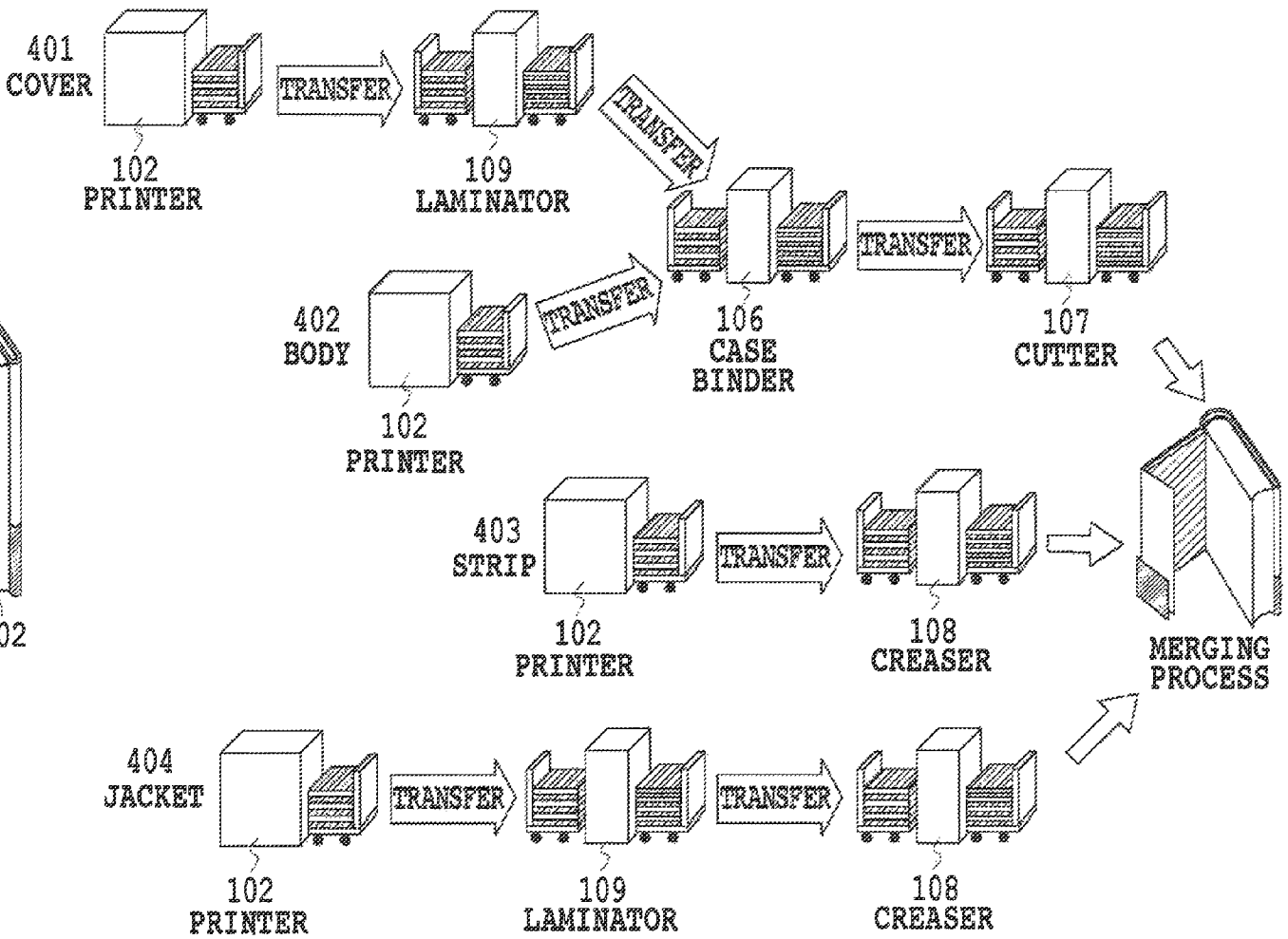
FIGS. 4A and 4E are showing an example of processes from the configuration of a photobook to the production of the photobook.
Figure 4A:
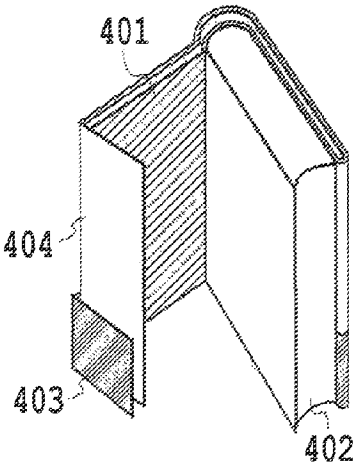

FIGS. 4A and 43 are views showing an example of processes from the configuration of the photobook and the production of the photobook. FIG. 4A is a view showing an example of the configuration of the photobook, and in this embodiment, four types of parts: a cover 401, a body 402, a strip 403 and a jacket 404 are combined to produce one photobook. The cover 401 and the body 402 are bounded in accordance with case binding processing, and are covered with the jacket 404 and further with the strip 403 thereon.

FIG. 4B is a view showing an example of the process of each part until the photobook is produced. Each part of the same type, is printed by the printer 102, each batch of the same outputted parts is manually transferred to the post-processors (106 to 109) and post-processing of each batch is performed.

A surface of the cover 401 is subjected to laminating processing by the laminator 100, and the cover 401 is transported to the case binder 106. The cover 401 and the body 402 are subjected to case binding by the case binder 106 to produce one book. In the case binding, the print, of the cover 401 and the print, of the body 402 are manually transported to the case binder 106, and sheets are set at different positions. Generally, the post-processing setting information previously transmitted, to the near-line post-processors (106 to 108) is reflected by reading the bar-codes printed on the cover 401 and the body 402. After performing the case binding, the book is cut by the cutter 107.

Meanwhile, in the process for the strip 403, the sheet is creased by the creaser 108 and cut. In the process for the jacket 404, after its surface is subjected to the laminating processing by the laminator 109, the sheet is creased by the creaser 108 and cut. Finally, by assembling each part, one photobook is completed.

As described above, the processes for the parts are the same in first executing the printing processing by the printer 102, but in the subsequent post-processing, the number of used post-processors and processes vary. Meanwhile, the device used for different parts, such as the printer 102, may be the same device or different devices. In addition, as long as the order of processes is met, a plurality of processes may be executed by the same device. For example, although the laminating processing and the creasing processing are executed by different devices, that is, the laminator 109 and the creaser 108 in the process of the jacket 404, the laminating processing and the creasing processing may be executed by one device capable of sequentially performing these processing processes. In following description, the lamination processing by the off-line laminator 109, in which the information processor 101 does not perform electronic control, is not specifically described.

Figure 5:
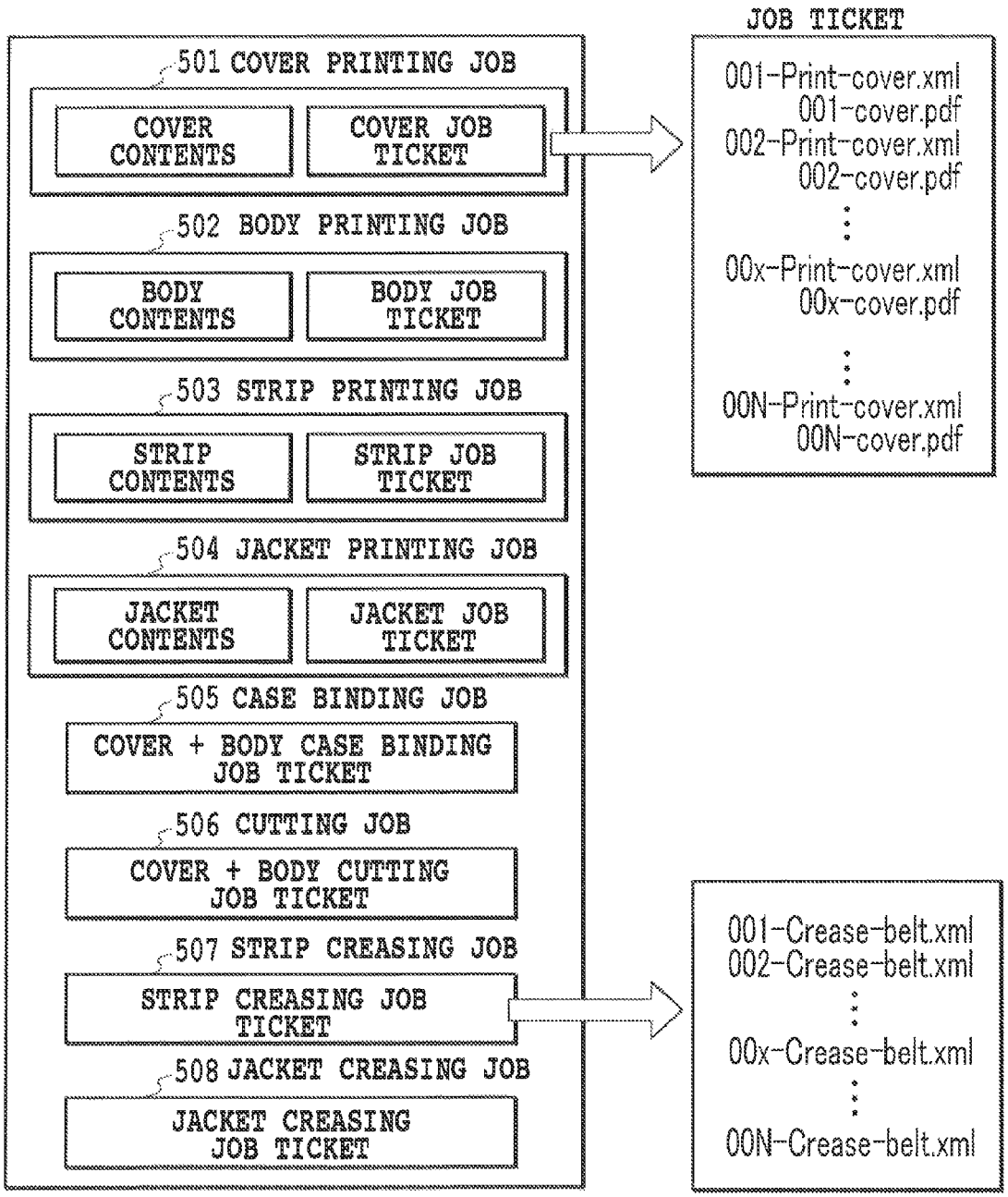
FIG. 5 is a diagram showing an example of a job configuration in the production of the photobook.

FIG. 5 is a view showing an example of a job configuration in the production of the photobook. In this embodiment, when receiving an order from the user, the information processor 101 generates contents and the job ticket in response to the order. In this embodiment, jobs generated, in one photobook order is constituted by eight jobs including printing jobs (501 to 504), a case binding job 505, a cutting job 506 and strip/jacket creasing jobs (507, 508) of each part. Since the printing jobs (501 to 504) are jobs relating to a printing process, they contain the contents and the print setting information of each part. Since the jobs other than the printing job are jobs relating to post-processing processes, they contain only the post-processing setting information.

In the example shown in FIG. 5, the printing job 501 of the cover is constituted by "001-cover.pdf to 00N-cover.pdf" as contents data and "001-Print-cover.xml to 00N-Print-cover.xml" as the print setting information. The creasing job of the strip is constituted by "001-Crease-belt.xml" to "00N-Crease-belt.xml" as the creasing processing setting information.

FIG. 6 is a view showing an example of description contents of xml data as printing/post-processing setting information, and defining cover printing setting.

For example, a description 602 defines a sheet used for printing and in this example, designates a sheet having a size "612×792 mm" in a sheet "tray 1," A description 603 sets the number of prints and in this example, instructs printing of three copies.

The information processor 101 transmits the printing and post-processing setting information to a device that can perform printing and post-processing. After transmission of the job, the printer 102 can perform printing. When the operator transports the print to the post-processors (106 to 108), the post-processors (106 to 108) can invoke transmitted processing setting parameters and perform post-processing of the print.

The printer 102 and the post-processors (106 to 108) sequentially processes a plurality pieces of xml data (job ticket) according to a predetermined rule. In this embodiment, it is assumed that the printer 102 and the pose-processors (106 to 108) reads the xml data in the order transferred from the information processor 101 and executes the job on the basis of setting described in the job ticket.

Example 1

Next, an example of job control processing by the information processor 101 in First embodiment will be described using a flow chart in FIG. 7. This processing is controlled by the CPU 301 according to a program extracted from a storage unit such as the ROM 306 and the hard disc 303 to the RAM 302.

In S701, the information processor 101 acquires information on an error-caused part from the finisher controllers (103 to 105) connected to the error-caused finishers (106 to 108). Alternatively, the information processor 101 acquires information on the error-caused part from the error-caused printer 102. Details of this processing will be described later with reference to FIG. 8.

Next, in S702, the information processor 101 updates the job ticket. This update processing of the job ticket varies depending on the state of the target part. In this example, three cases: "1. error-caused part", "2. unprinted part of a type different from that of error-caused part" and "3. printed part of a type different from error-caused part" will be described. Details of this processing will be described later with reference to FIG. 9 and FIGS. 11A and 11B.

Finally, in S703, the information, processor 101 transmits the job ticket updated in S702 to each device (printer 102, finisher controllers (103 to 105) and finishes the job control processing. Describing in detail, the information processor 101 informs each device of change in the job order of the part determined that the reprinting is necessary (determining method will be described later with reference to FIG. 8) and change in the job order of other parts constituting the same photobook (book) as the part determined that the reprinting is necessary.

As described above, according to the processing shown in FIG. 7, the information processor 101 receives information on the error-caused in the finishers, updates the job ticket on the basis of the error information and transmits the updated job ticket to each device.

Figure 8:
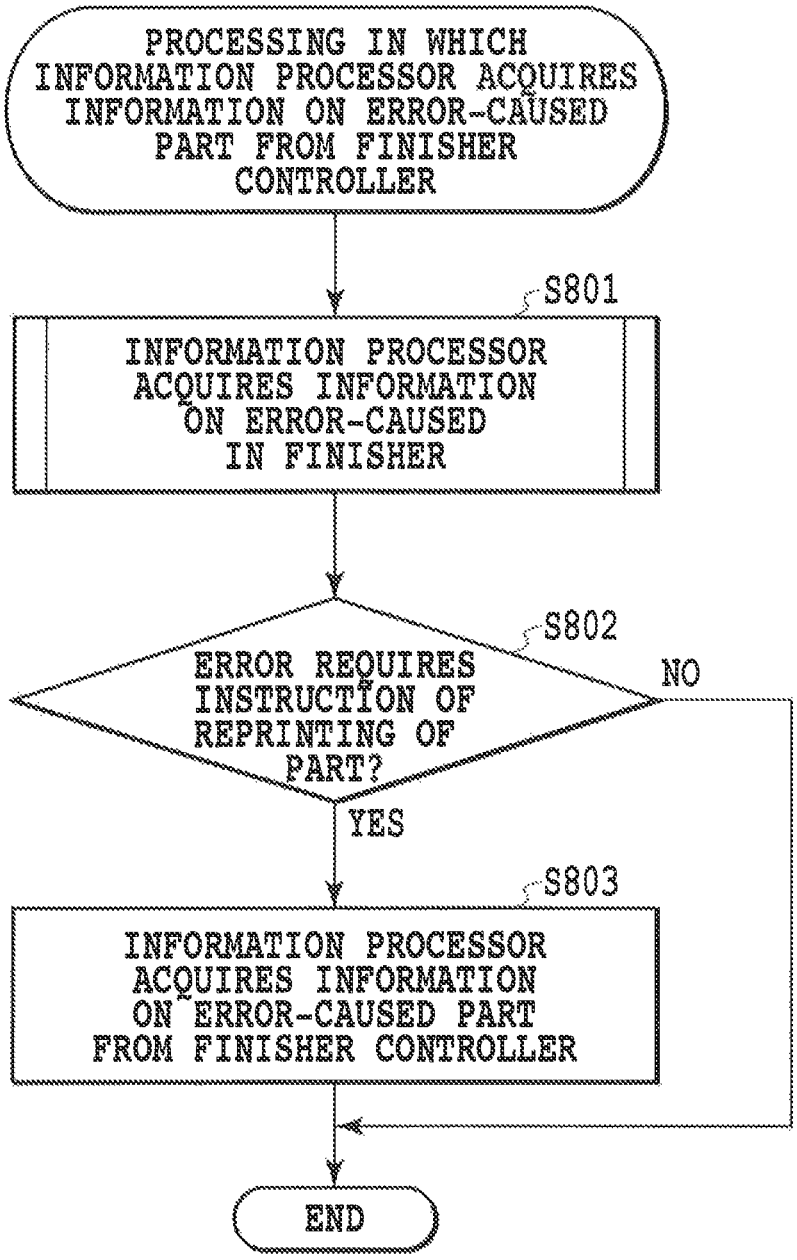
FIG. 8 is a diagram, showing an example of processing of acquiring information on an error-caused part in Example 1.

FIG. 8 shows a flow of processing (S701) in which the information processor 101 acquires information, on the error-caused part from the finisher controllers (103 to 105). Although not described separately, the same applies to processing in which the information processor 101 acquires information on the error-caused part from the printer 102.

In S801, the information processor 101 acquires (receives) information on the error-caused in the printer 102 or the finishers (106 to 108) (error information) from the printer 102 or the finisher controllers (103 to 105). The error information is, for example, an error code defined for each device.

Next, in S802, the information processor 101 determines whether or not reprinting of the error-caused part is necessary on the basis of the error information, acquired in S801. The information processor 101 previously holds, in the hard disc 303, information on whether or not reprinting of the part is necessary with respect to the error codes of all devices. Based on the information, the information processor 101 determines whether or not reprinting of the part, is necessary. For example, when the error code is caused in the case binder 106 due to sheet jam or redundant delivery, the information processor 101 determines that reprinting is necessary. In contrast, when the error code is caused in the case binder 106 due to a decrease in remaining amount of an adhesive that combines the body with the cover, the information processor 101 determines that reprinting is not needed.

When determining that reprinting is not needed in S802, the information processor 101 finishes processing.

When determining that reprinting is necessary in S802, in S803, the information processor 101 acquires information on the error-caused part from the finisher controllers (103 to 105). Examples of the information on the error-caused part herein include the type of part, the job ID, order ID, the error-caused process and the order of the part in the batch (at which order parts are processed?).

Meanwhile, although the information processor 101 determines the necessity of reprinting on the basis of the error information in the above description, the present invention is not limited to this, and the finisher controllers (103 to 105) may make a determination. In this case, the finisher controllers (103 to 105) previously hold information on whether or not reprinting of the part is necessary with respect to the error codes of the finishers (106 to 108) to which the finisher controllers (103 to 105) are connected. Then, the finisher controllers (103 to 105) inform the information processor 101 of the result of determining the necessity of reprinting based on the information. Hereinafter, details of the processing (S702) in which the information processor 101 updates the job ticket will be described below.

[1. Case of Error-Caused Part]

Figure 9:
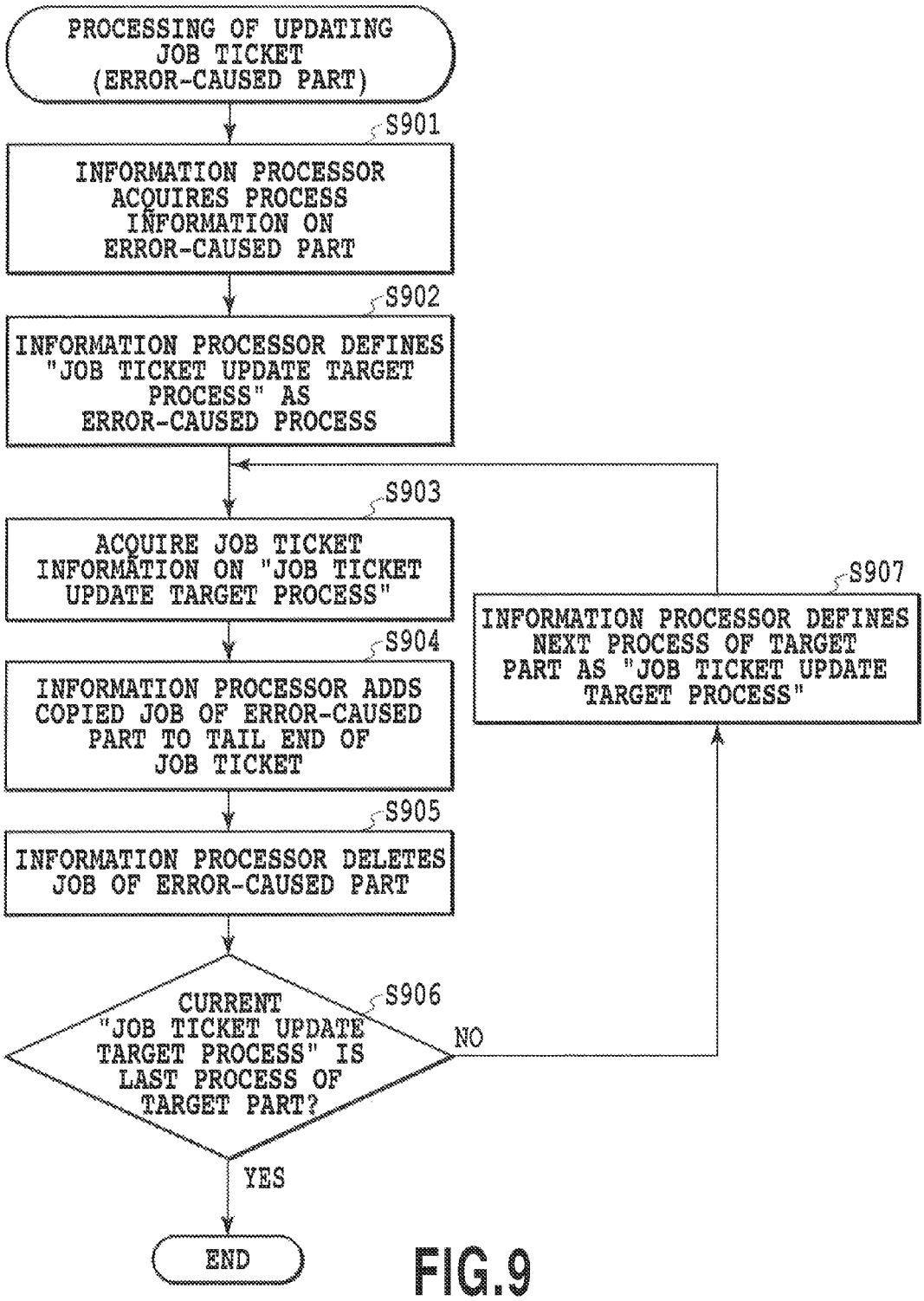
FIG. 9 is a diagram showing an example of processing of updating a job ticket of the error-caused part in Example 1.

FIG. 9 shows a flow of the processing in which the information processor 101 updates the job ticket of the "error-caused part".

First, in S301, the information processor 101 acquires the process information 119 of the error-caused part.

The process information 119 contains process order information 1001 and merging process information 1002, shown in FIG. 10.

The process order information 1001 in FIG. 10A represents the order of processes through which each part passes. For example, the cover part passes through the printing process, the case binding process, the cutting process and the assembling process in this order. The merging process information 1002 in FIG. 10B represents a process in which a target part merges with other parts. For example, it is apparent from the merging process information 1002 that the cover part merges with the body part in the case binding process and the strip part merges with the jacket part, in the assembling process. In Example 1, the information processor 101 uses only the process order information 1001.

Next, in S902, the information processor 101 defines a process in which an error is caused as a "job ticket update target process".

In S903, the information processor 101 acquires job ticket information on the target part in the job ticket update target process. In this example, although the information on the job ticket is stored in the information processor 101 until jobs of all parts are finished and the product is completed, the present invention is not limited to this. The finisher controllers (103 to 105) rather than the information processor 101 may hold, the job tickets processed by them.

Then, in S904, the information processor 101 adds a copied job ticket of the error-caused part to the tail end of a group of job tickets.

Subsequently, in S905, the information processor 101 deletes the job ticket of the error-caused part.

In S906, the information processor 101 determines whether or not the current, job ticket update target, process is the last process of the current target part, on the basis of the error-caused part information acquired from the finisher controllers (103 to 105) in S701 and the process order information 1001 acquired in S901.

Figure 13:
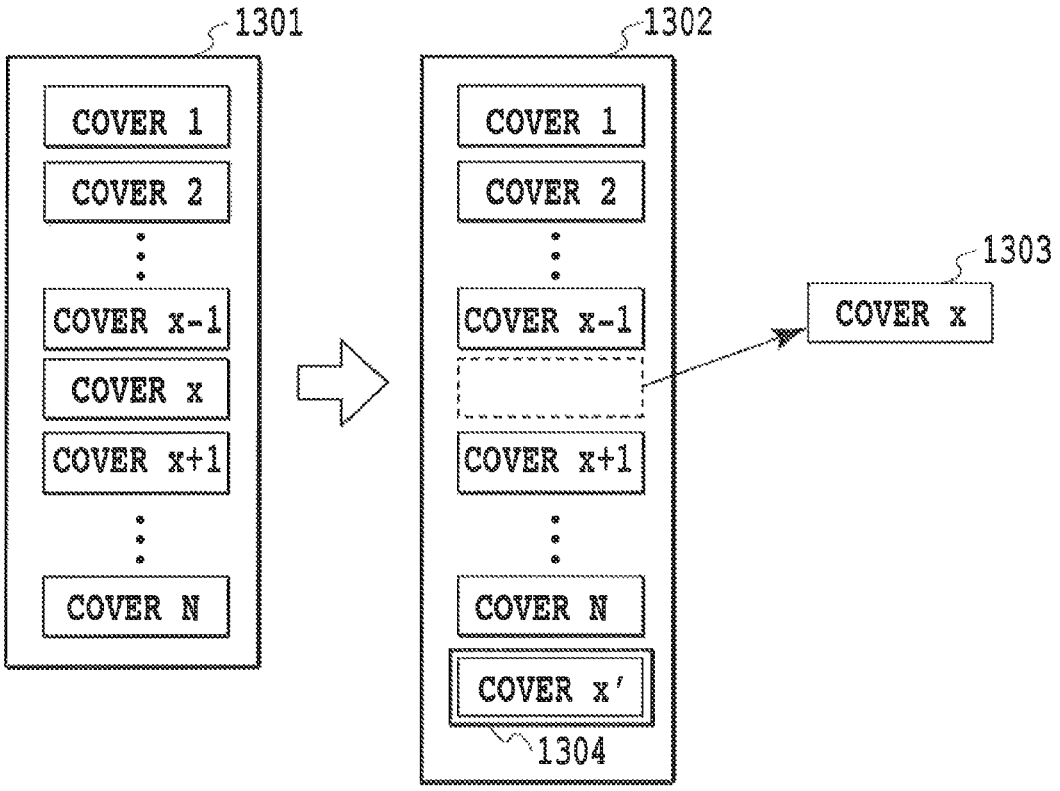
FIG. 13 is a diagram showing change in the physical order of the error-caused part in a batch.
Figure 14:
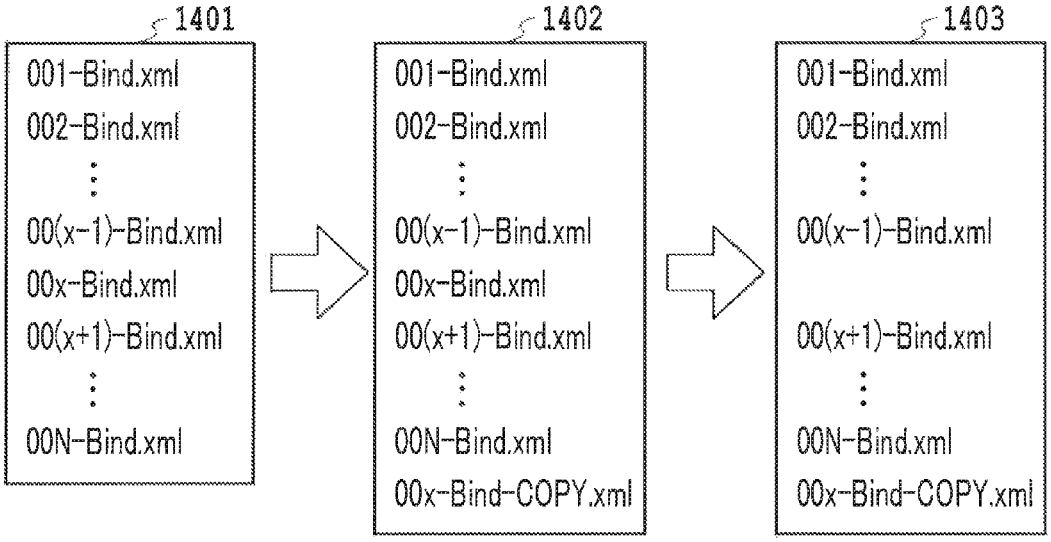
FIG. 14 is a diagram showing a state where the job ticket of the error-caused part is updated.

When determining that the current job ticket update target process is the last process of the current, target part in S906, the information processor 101 finishes this process flow. In contrast, when, determining that the current job ticket update target process is not the last process, in S907, the information processor 101 defines a next process represented by the process order information 1001 as the job ticket update target, process and proceeds to processing in S903. As a specific example, change in the job ticket of the cover part and physical movement of the cover part in the part batch in the case where an error of the cover part is caused in the case binding process will be described with reference to FIGS. 13 and 14. FIG. 13 is a view showing the state of change in the physical order of the cover part in the batch. FIG. 14 is a view showing the state where the job ticker, is changed. Before the error is caused in the part, the information processor 101 issues the job tickets represented by 1401 in FIG. 14 to the finisher controllers (103 to 105). The N job tickets in total are aligned in order from 1 to N as represented by leading numerical values of xml data, file names. In accordance with the alignment, of the job tickets, the finisher controllers (103 to 105) wait to control the finishers (106 to 108) to process the N cover parts in total in order from 1 to N (1301).

Here, when an error is caused in the $x^{th}$ cover, the information processor 101, in S904, adds "00x-Bind-COPY.xml" as a copy of the $x^{th}$ job ticket "00x-Bind.xml" to the tail end of a group of job tickets. 1402 in FIG. 14 shows the group of job tickets at this stage.

Next, the information processor 101, in S905, deletes the job ticket "00x-Bind.xml" of the $x^{th}$ part. 1403 in FIG. 14 shows a group of job tickets in this stage.

In all processes through which the cover part passes, the information processor 101 transmits the group of job tickets thus updated to the printer 102 and the finisher controllers (103 to 105). 1302 in FIG. 13 shows the part batch to be processed in various subsequent processes. An original cover x 1303 located at the $x^{th}$ order becomes unusable due to an error and is discarded. Meanwhile, according to the copied job ticket, a reprinted copy 1304 of the cover x is located at the tail end of the batch.

As described above, according to the processing shown in FIGS. 9, 10, 13 and 14, the job ticket of the error-caused) part is updated and one order of the job ticket is changed. As a result, the job order can be changed without human intervention while leaving the recovery operation of the error-caused part until later.

[2. Case of Imprinted Part of a Type Different from that of Error-Caused Part]

Figures 11, 11A:
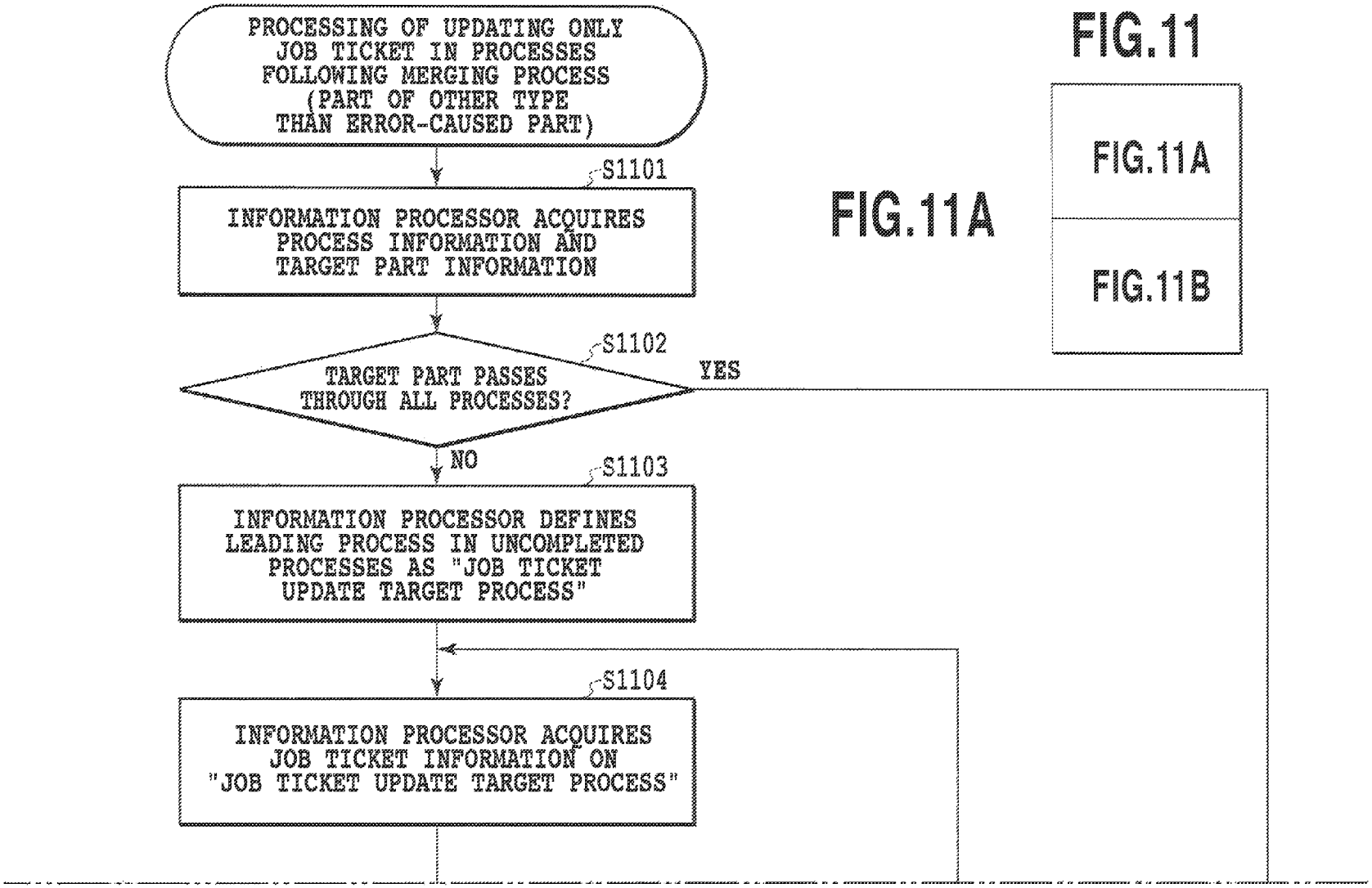
FIG. 11 is a diagram showing the relationship of FIGS. 11A and 11B.
FIGS. 11A and 11B are showing an example of processing of updating the job ticket of a part other than the error-caused part in Example 1.
Figure 11B:
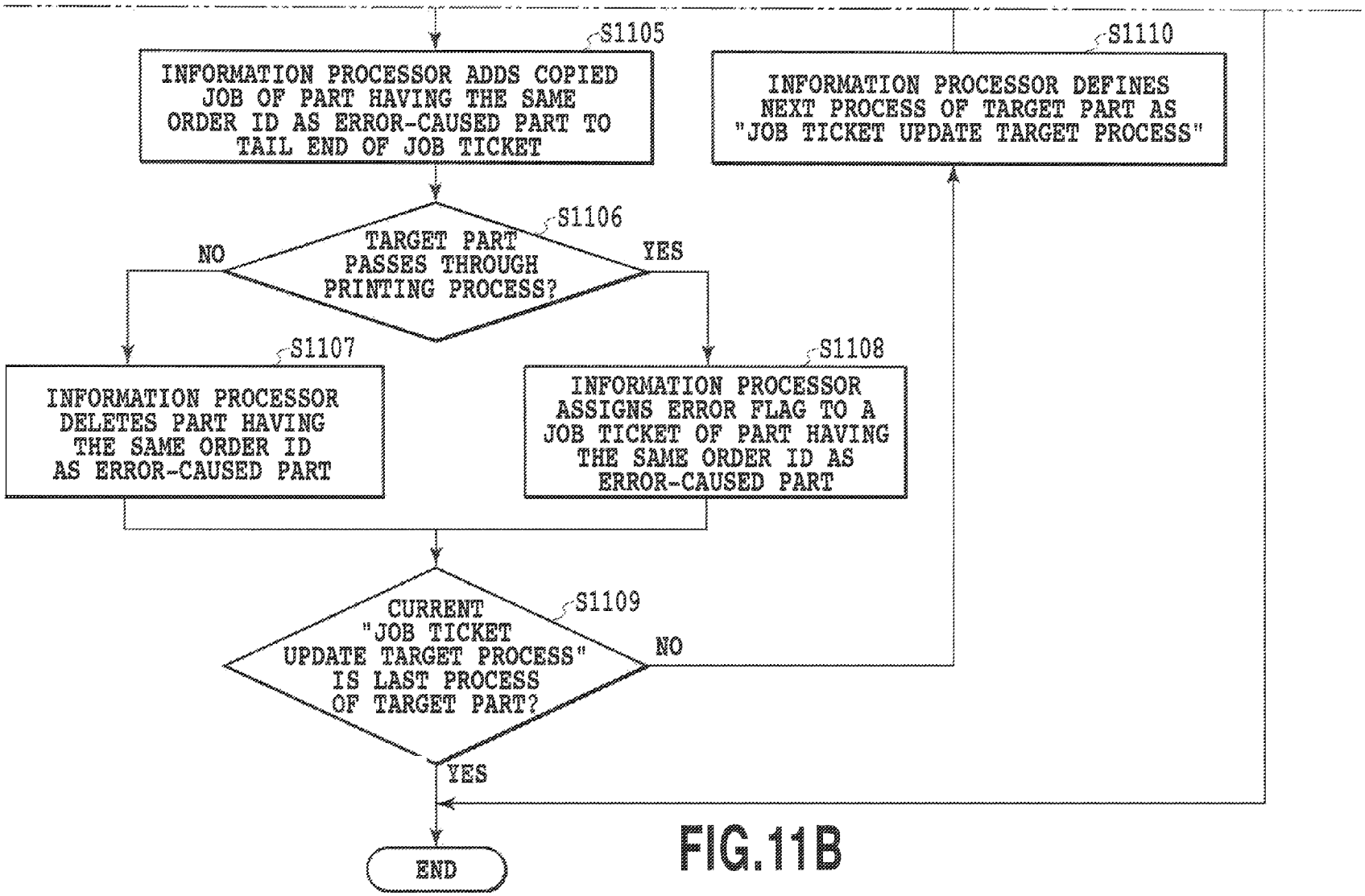

FIGS. 11A and 11B show a flow of processing in which the information processor 101 updates the job ticket of "the part other than the error-caused part". The information processor 101 executes below-described processing with respect to all parts other than the error-caused, part. First, in S1101, the information processor 101 acquires the process information 119 and target part information. The target part information is information indicating the current processed state of the target part. The information processor 101 finds the finishers (106 to 108) through which the target part passes on the basis of the process order information 1001. Then, the information processor 101 acquires the current progress state of processing of the target part from the finisher controllers (103 to 105) connected to the finishers. That is, the information processor 101 can recognize which processing process the target part is located at.

Next, in S1102, the information processor 101 determines whether or not the target part passes through all processes on the basis of the process order information 1001 and the target part information, which are acquired in S1101. When determining that the target part passes through all processes, the information processor 101 finishes processing. In contrast, when determining that the target part does not pass through all processes, the information processor 101 defines a process located in the most upstream side among uncompleted processes as the "job ticket update target process" in S1103. That is, in S1103, the "job ticket update target process" is decided by using the process order information 1001 and the target part information.

In S1104, the information processor 101 acquires the job ticket information on the job ticket in the job ticket target process. This step is the same as S903 and thus, detailed description thereof is omitted. Subsequently, in S1105, the information processor 101 adds the copied job ticket of the part having the same order ID as the error-caused part to the tail end of the group of job tickets.

In S1106, the information processor 101 determines whether or not the target part completes the printing process on the basis of the information, acquired in S1.101. When determining that the target part is not printed, the information processor 101 proceeds to processing in S1107.

In S1107, the information processor 301 deletes the job ticket of the part, having the same order ID as the error-caused part.

Then, in S1109, the information processor 101 determines whether or not the current job ticket update target process is the last process of the target part, on the basis of the process order information 1001 and the target part information, which are acquired in S1101. This step is the same as S906 and thus, detailed description thereof is omitted.

Figure 15:
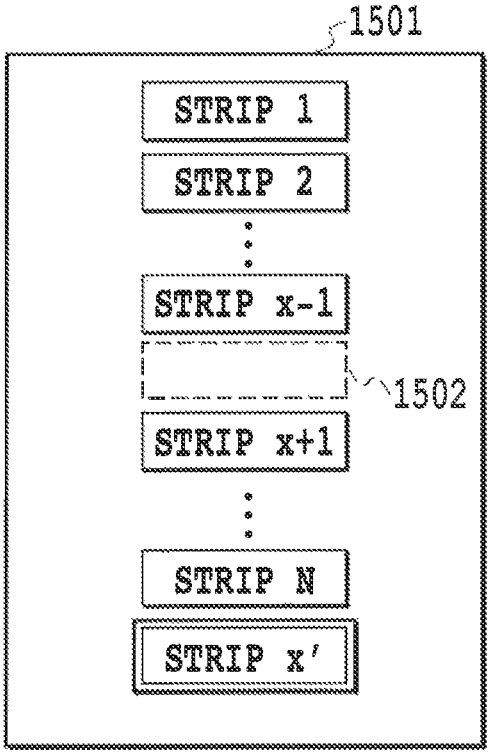
FIG. 15 is a diagram showing a state of change in the physical order of an imprinted part other than the error-caused part.
Figure 16:
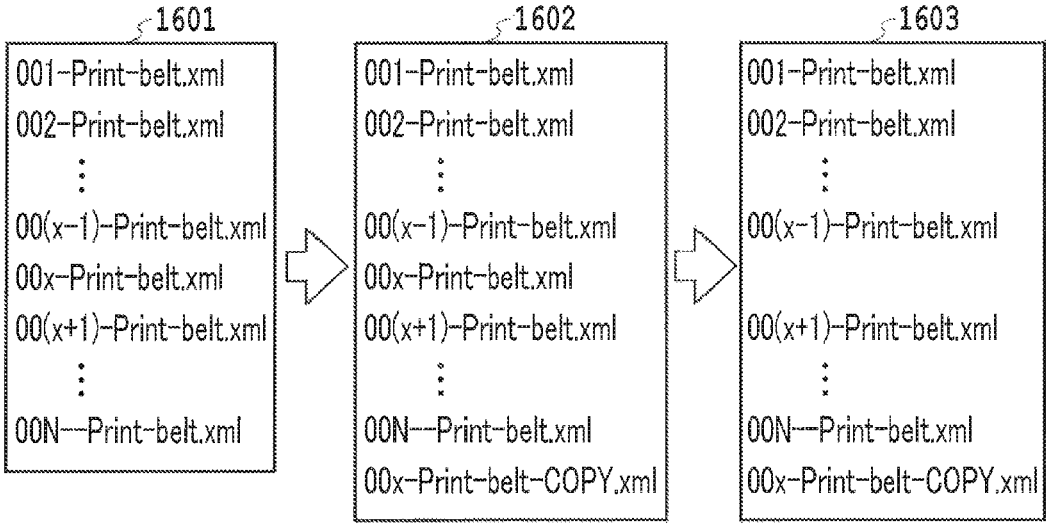
FIG. 16 is a diagram showing a state of updating of the job ticket of the unprinted part other than the error-caused part.

FIGS. 15 and 16 show, as a specific example, change in the job ticket of the strip part to be printed and physical movement of strip parts in the part batch at the time when an error is caused in the cover part in the case binding process. FIG. 15 is a view showing the physical order of the strip parts in the batch. FIG. 16 is a view showing a state where the job ticket of the strip part is changed.

A reference numeral 1601 in FIG. 16 shows the job tickets of the strip part transferred from the information processor 101 to the printer 102 when an error is caused in the cover part. In the job rickets, N strip part jobs are aligned in the order of 1 to N. The printer 102 waits to print N strip parts in the order of 1 to N according to the job tickets.

When an error is caused in the cover part in this state, first, in S1103, the information processor 101 determines the printing process as the "job ticket update target process". Then, in S1105, the information processor 101 adds "00x-Print-belt-COPY.xml" as a copy of the $x^{th}$ job ticket "00x-Print-belt.xml" to the tail end of a group of job tickets. A reference numeral 1602 in FIG. 16 shows the group of job tickets in this stage.

Next, the information processor 101, in S1107, deletes the job ticket "00x-Print-belt.xml" of the $x^{th}$ part. A reference numeral 1603 in FIG. 16 shows a group of job tickets in this stage. A reference numeral 1501 in FIG. 15 shows the physical order of the strip part batch output from the printer 102 according to the job tickets thus changed. Since the job ticket of a strip x 1502 to be located at the $x^{th}$ position is deleted, the strip is not printed in this order, A copied part 1503 of the strip x is outputted at the tail end in the batch according to the copied, job ticket.

The information processor 101 determines the process through which the strip part passes on the basis of the process order information 1001 in FIG. 10A, changes the job tickets with respect to each process (creasing process, assembling) as described above and then, transmits the job tickets to the finishers (106 to 108).

As described above, according to the processing shown in FIGS. 11A, 11B, 15 and 16, the job ticket of an unprocessed part other than the error-caused part is updated to change the order of the job ticket. As a result, the job order of the other part constituting the same order as the error-caused part, can be changed without human intervention while leaving the recovery operation of the error-caused part.

[3. Case of Printed Part of a Type Different from that of Error-Caused Part]

A flow of processing the job ticket of the "printed part of other type than error-caused part" will be described with reference to FIGS. 11A and 11B.

S1101 to S1106 are described above and thus, description thereof is omitted. In S1106, when determining that the target part is printed, the information processor 101 proceeds to processing in S1108.

In S1108, the information processor 101 adds an error flag to the job ticket of a part having the same order ID as the error-caused part to update the job ticket. The error flag, as shown in FIG. 6 for example, can be defined as a parameter "ErrorFlag" 604 in the job ticket. The information processor 101 changes the error flag parameter 604 of the job ticket from 0 (OFF) to 1 (ON).

In addition, the finisher controllers (103 to 105) can recognize the error flag 604 and switch the operation of the finishers (106 to 108) depending on a value of the error flag. As described later, when the error flag is ON, the finisher controllers (103 to 105) promote the change in the part processing order by the operator. That is, the error flag acts as information for promoting the change in the part processing order by the operator. Details of switching of the operation of the finishers (106 to 108) will be described later.

S1109 and S1110 are described above, and thus description thereof is omitted.

Figure 12:
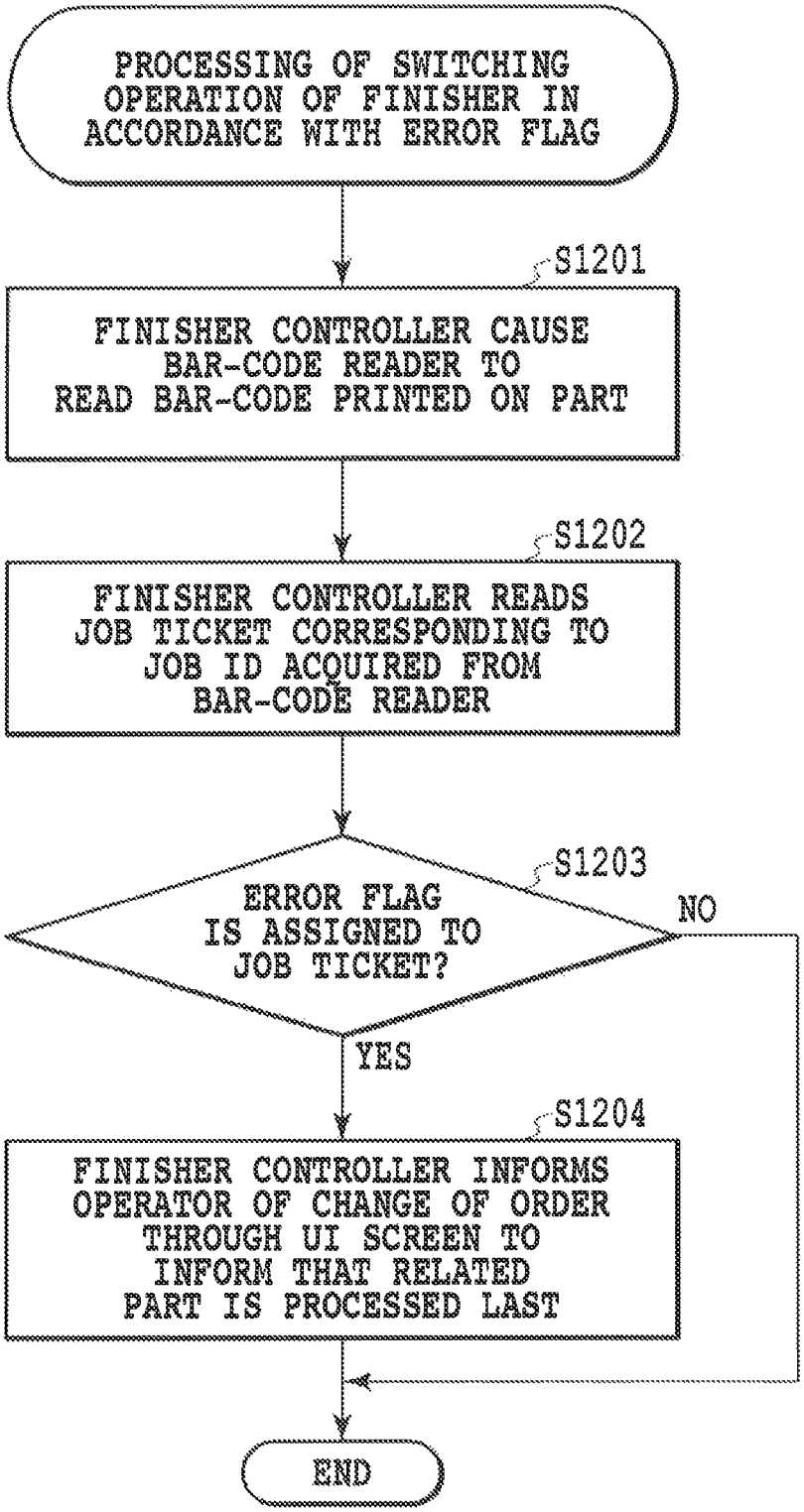
FIG. 12 is a diagram showing an example of processing of switching an operation of a finisher according to presence/absence of an error flag in Example 1.

Here, processing in which the finisher controllers (103 to 105) switch the operation of the finishers (106 to 108) to the job having the error flag will be described with reference to FIG. 12.

First, a batch of the parts including the part corresponding to the job ticket having the error flag ON is transferred to the finishers (106 to 108) by the operator. In S1201, the finisher controllers (103 to 105) cause the bar-code reader to read the bar-code printed on the part.

Next, in S1202, the finisher controllers (103 to 105) check the job ID acquired from the bar-code reader and read the corresponding job ticket from the job ticket stored in the finisher controllers.

Then, in S1203, the finisher controllers (103 to 105) decode the read job ticket and determines whether or not the error flag is ON.

When the error flag in the job ticket is OFF, the finisher controllers (103 to 105) finish processing of the part and start processing of the next part.

In contrast, when the error flag in the job ticket is ON, in S1204, the finisher controllers (103 to 105) inform the operator of the occurrence of change in the job order, through their UI screens. Then, the finisher controllers (103 to 105) promote processing of the part at the end of the part batch, by the operator. FIG. 19 shows an example of the UI that informs the operator.

Figure 17:
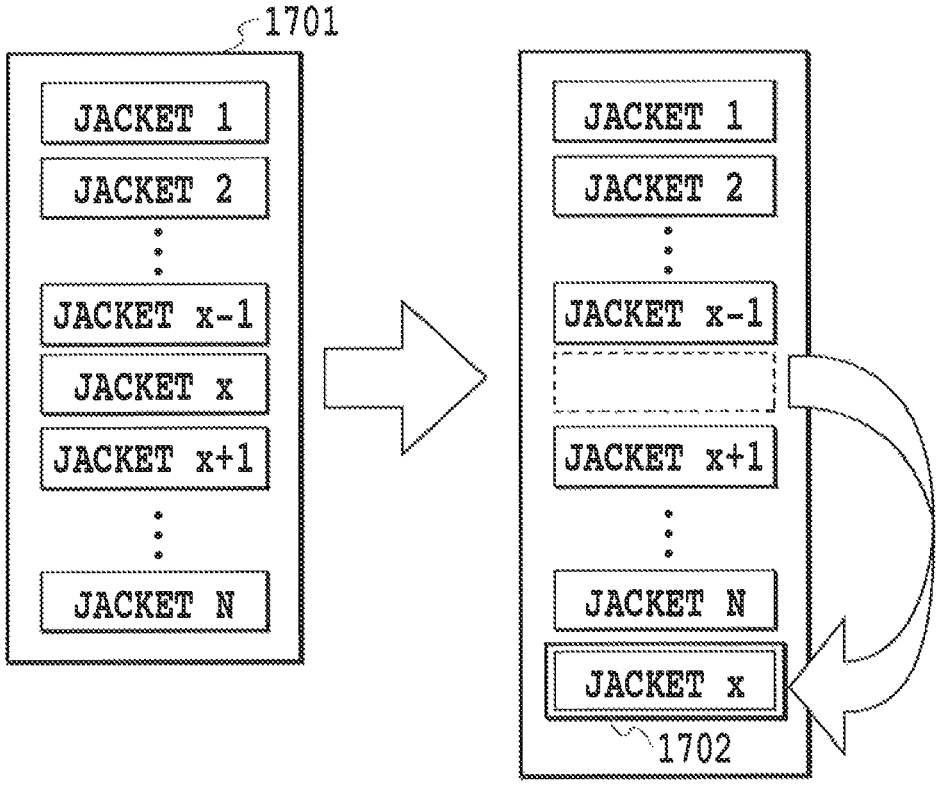
FIG. 17 is a diagram, showing a state of change in the physical order of the printed part, other than the error-caused part in the batch.
Figure 18:
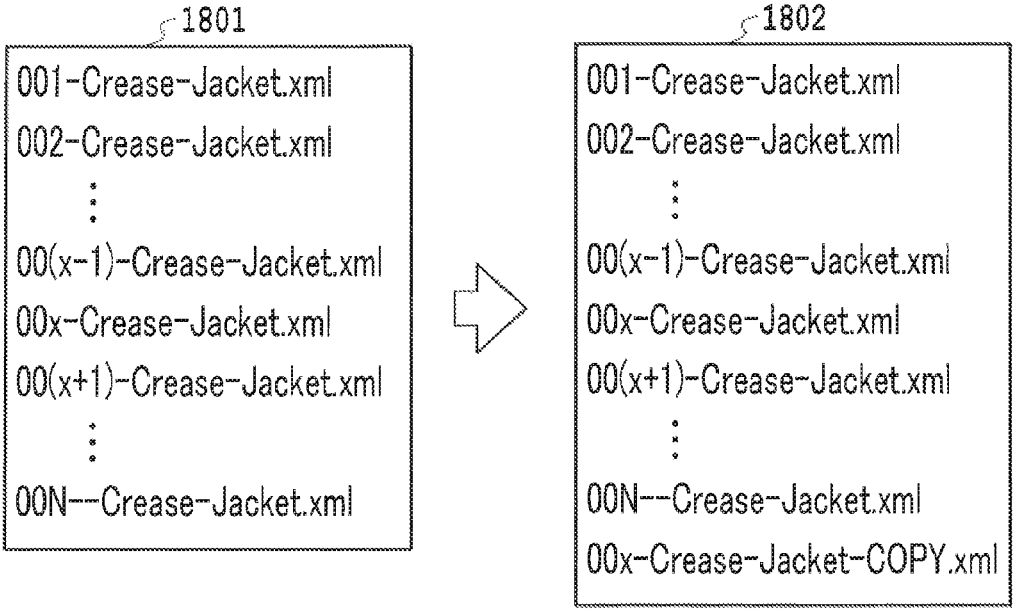
FIG. 18 is a diagram showing a state of updating of the job ticket of the unprinted part other than the error-caused part.

As described above, in accordance with processing in S1204, when the job ticket of another part in the same order as the printed part, is updated, the finisher controllers (103 to 105) inform, the operator of the fact and promote the movement of the part by the operator. As a result, it is possible to reduce the possibility that, when the job ticket of another part constituting the same order as the printed part is updated, the operator executes processing in the wrong processing order. As a specific example, with respect to the jacket part already printed at the time when an error is caused in the cover part in the case binding process, change in the job ticket and physical movement of the part in the batch will be described with reference to FIGS. 17 and 18. In this specific example, it is assumed that the job ticket is changed after the jacket part is printed and before the jacket, part is transferred to the next creasing process. FIG. 17 is a view showing the physical order of the jacket part in the batch. FIG. 18 is a view showing a state where the job ticket of the jacket part is changed.

Before the error is caused in the cover part, the information processor 101 transfers the job tickets of the strip part, shown in reference numeral 1801 in FIG. 18, to the printer 102. In the job tickets, N jacket part jobs are aligned in order from 1 to N. A reference numeral 1701 in FIG. 17 shows the physical order of the jacket part batch that is output from the printer 102 and then, is processed in the creasing process in accordance with this job tickets.

When an error is caused in the cover part in this state, first, in S1103 in FIG. 11A, the information processor 101 determines the creasing process as the "job ticket update target process".

Then, in S1105, the information processor 101 adds "00x-Crease-Jacket-COPY.xml" as a copy of the $x^{th}$ job ticket "00x-Crease-Jacket.xml" to the tail end of a group of job tickets.

Next, the information processor 101, in S1108, turns the error flag of the job ticket of the $x^{th}$ part "00x-Print-belt.xml" ON, A reference numeral 1802 in FIG. 18 shows a group of job tickets in this stage. The group of job tickets thus updated is transferred to the creaser controller by the information processor 101.

At this time, the physical order of the jacket part batch transferred to the creasing process is the same as that shown in reference numeral 1701 in FIG. 17.

Then, when determining that the error flag is added to an $x^{th}$ jacket x 1702 in S1203, the finisher controller 105 instructs the operator to change the order so as to move the part to the tail end of the batch (S1204).

The information processor 101 performs the same control with respect to all processes through which the jacket part passes thereafter.

In this example, it is possible to provide a method that can be applied, to a photobook production flow handling a plurality of parts and reduce the operator's error recovery operation of keeping consistency in the job order between the plurality of parts at the time of occurrence of an error.

That is, in the book binding operation of a product such as the photobook including a lot of constituents, when a device or human error is caused, the job order of the error-caused part as well as all related parts can be automatically changed with ease. In addition, the job, the order of which is changed, can be easily identified, and thus the confirmation of the job ID by the operator's visual check becomes unnecessary. Furthermore, a situation is prevented in which processing is wrongly executed in the unchanged job order and thus the part is lost. Moreover, in the operator's manual operation such as movement of the part, notification of the part that requires the operation is provided. Therefore, it is possible to prevent a situation in which the job of the part with wrong order is executed.

Example 2

The information processor 101 may manually inform the operator of the fact that an error is caused and the job ticket needs to be changed. That is, the information processor 101 may receive information manually inputted by the operator of the finisher controller as error information.

In the above example, the information processor 101 automatically determines the occurrence of the error and the necessity of change in the job ticket on the basis of the error information received from the finisher controllers (103 to 105). However, this method cannot address an error that is not handled as an error by the device even when an error is actually caused. For example, in the creaser 108, a slant of the sheet is caused depending on factors such as the type and thickness of the sheet. However, even when the slant is caused, the creaser 108 does not recognize the slant as an error and continues to execute subsequent processing.

Figure 20:
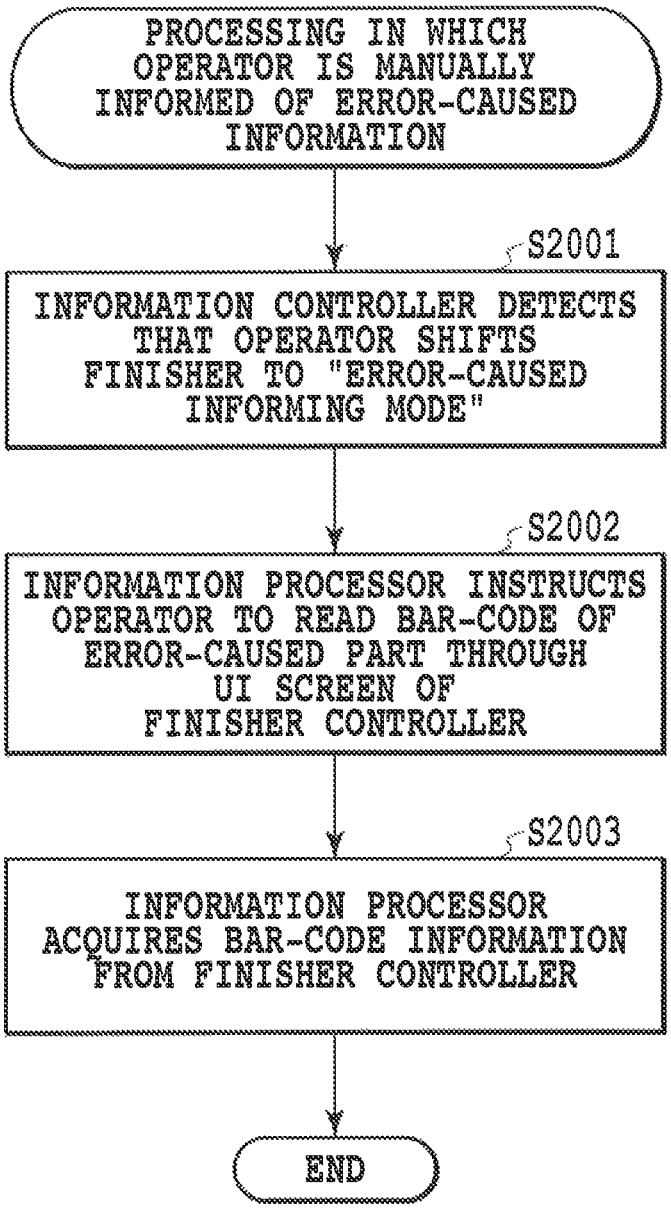
FIG. 20 is a flow chart showing a processing process in Example 2.

Details of this example, will be described using a flow chart in FIG. 20. First, the information processor 101, in S2001, detects that the operator shifts the finishers (106 to 108) to an "error informing mode". As a specific example, a switch as a unit that allows the operator to shift the finishers to the "error informing mode" is provided on the UI of the finisher controllers (103 to 105).

Next, in S2002, the information processor 101 instructs the operator to read the bar-code printed on the error-caused part by use of the UI screens of the finisher controllers (103 to 105).

Then, the information processor 101, in S2003, acquires read bar-code information from the finisher controllers (103 to 105) and as in Example 1, executes the job ticket update processing.

In accordance with this method, even when the error that is not treated as an error by the device is caused, the operator can determine to start the automatic update operation of the job ticket, thus reducing the operator's workload of the recovery operation.

Example 3

In this example, in S701, a case where, when information on the error-caused part determined that the reprinting is necessary is acquired, the error-caused part cannot be used repeatedly will be described. In this example, the information processor 101 automatically generate the job tickets for reprinting and re-post-processing of the error-caused part itself (that is, automatically generate again the printing and post-processing jobs of the error-caused part) and transmits the job tickets to the devices and the device controllers.

In addition to Examples 1 to 2, the operator's workload of the recovery operation can be further reduced by automating printing of the part that needs to be reprinted due to an error and also instruction of post-processing.

Meanwhile, at the time when the information processor 101 instructs the printer 102 to reprint the part, the printer 102 may be performing another printing job. However, it may be preferable to proceed to the recovery operation without, waiting completion of the printing job under execution depending on the device usage state at the site and the operator's operating schedule. In order to cope with such situation, the information processor 101 may instruct the printer 102 to perform interruption printing of interrupting the printing job under execution and preferentially starting printing of the error-caused part.

Furthermore, when instructing the interruption printing, the information processor 101 may also instruct the printer 102 to eject the sheet to a sheet receiving place other than a normal sheet receiving place. By changing the sheet receiving place, the operator can easily distinguish a desired output from other printed outputs.

Example 4

In the Examples 1 to 3, with respect to the part of a type different from that of the error-caused part, the job ticket changing operation in all of remaining processes is performed. However, the change in the order of the error-caused part has an effect on the part of the other type only in the process in which the part merges with the error-caused part and the subsequent processes and thus, there is no problem even when the change in the previous processes is not considered.

Therefore, in this example, with respect to the part of a type different from that of the error-caused part, only the job ticket in the process in which the target part merges with the error-caused, part and the subsequent processes is updated, and each device is informed of the updated job ticket. Details of this example will be described by using a flow in FIGS. 21A and 21B.

S2101, S2102 are the same as S1101, S1102, respectively, and thus description thereof is omitted.

In S2103, the information processor 101 acquires the merging process information 1002 of the target part and the error-caused part and in S2104, defines the acquired merging process as the job ticker update target process. That is, the information processor 101 identifies the process in which the part that needs to be reprinted merges with another part that constitutes the same photobook (book) as the part that needs to be reprinted. The identified process becomes the job ticket update target process.

S2105, S2106 are the same as above-mentioned S1104, S1105, respectively, and thus, description thereof is omitted.

S2107 to S2109 are the same as above-mentioned S1108 to S1110, respectively, and thus, description thereof is omitted.

Figure 7:
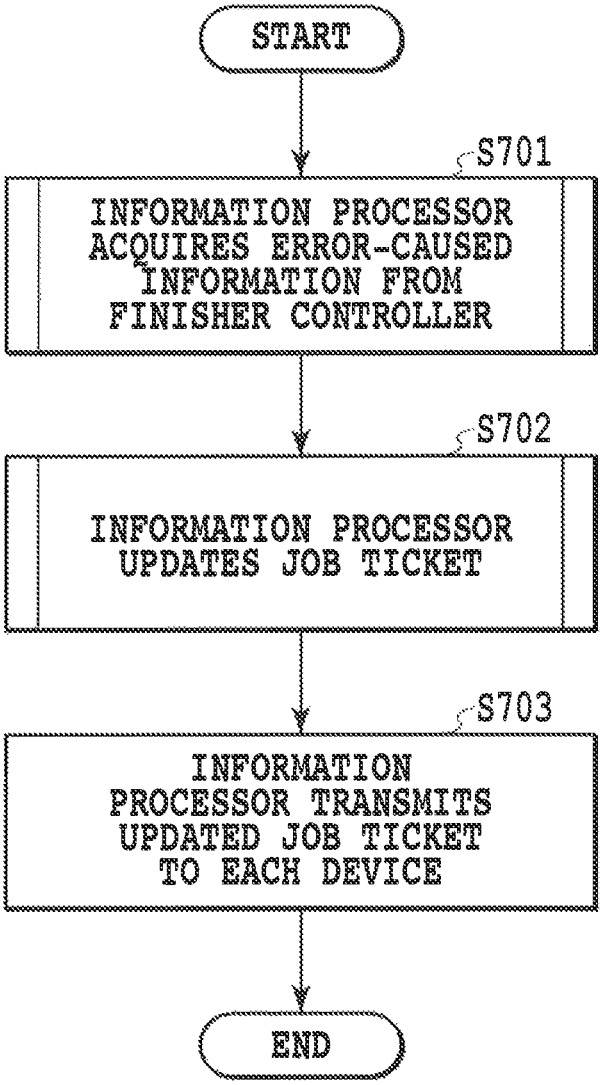
FIG. 7 is a flow chart showing a main processing process in Example 1.
Figure 21:
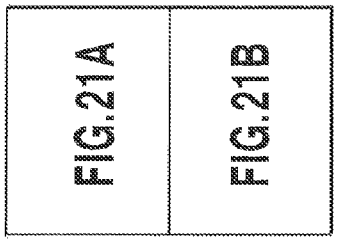
FIG. 21 is a diagram showing the relationship of FIGS. 21A and 21B.
Figure 21A:
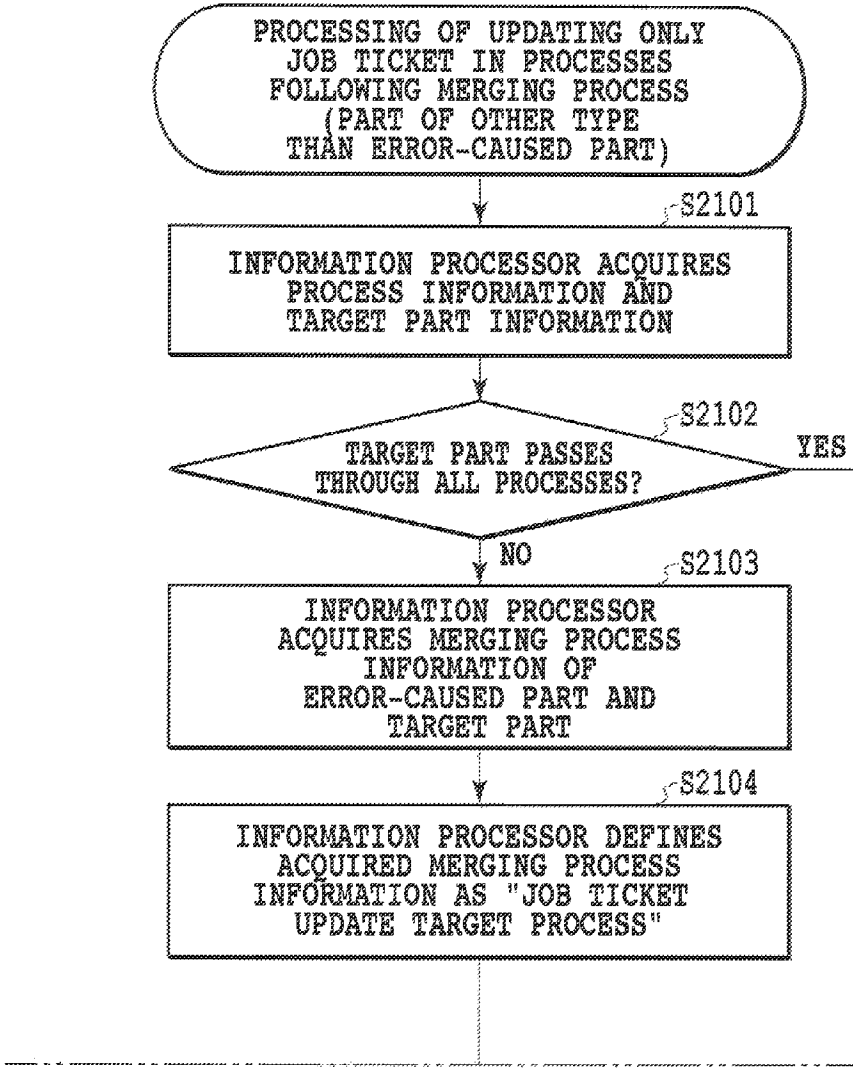
FIGS. 21A and 21B illustrate a flow chart showing a processing process in Example 4.
Figure 21B:
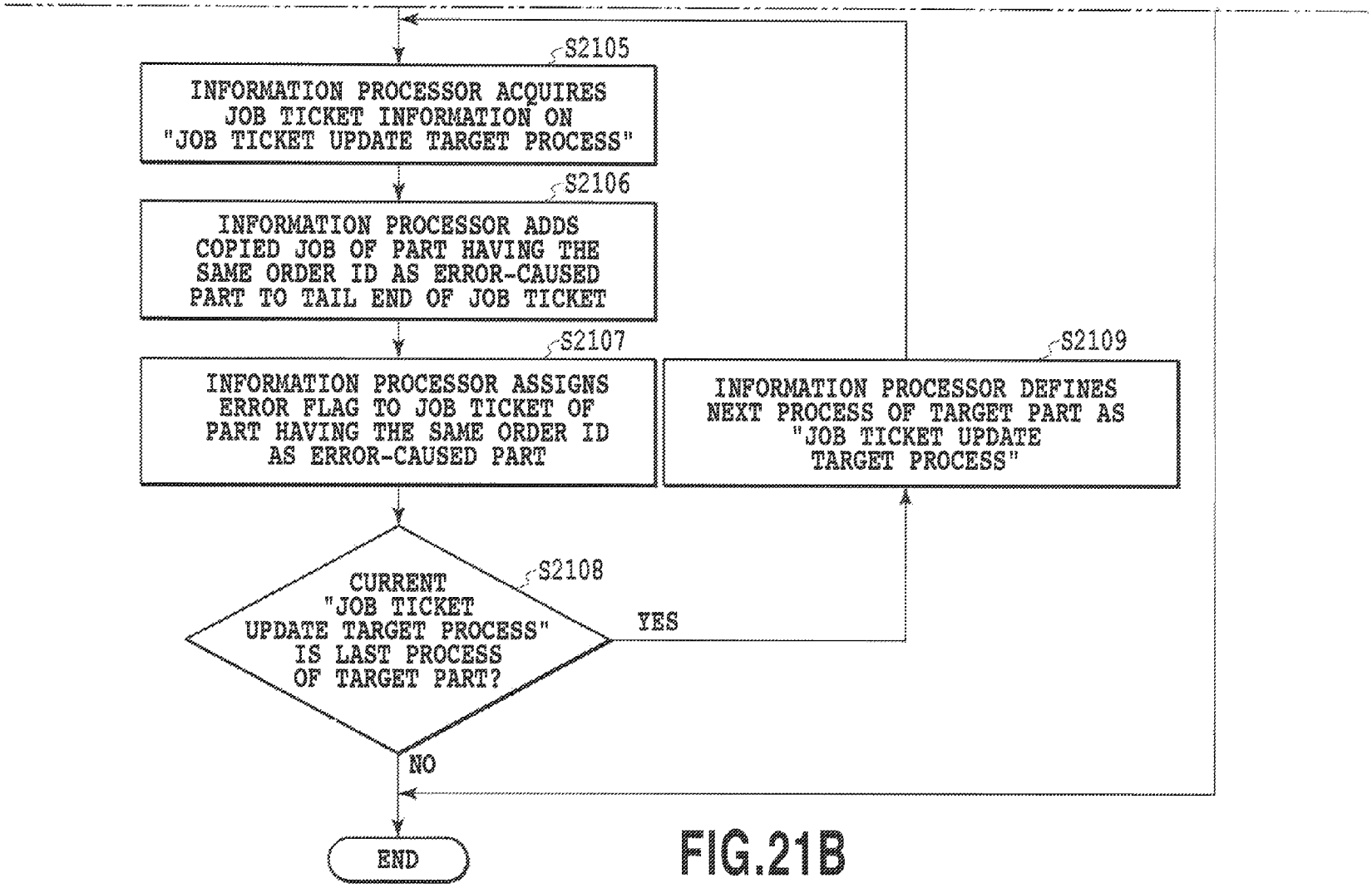

Following the processing shown in FIGS. 21A and 21B, in S703 in FIG. 7, the information processor 101 informs each corresponding device of change in the job order.

In accordance with this method, updating of the job ticket in the process prior to the process in which the target part merges with the error-caused part can be omitted. For this reason, unnecessary information exchange between the information processor 101 and the finisher controllers (103 to 105) can be eliminated, and the process interrupted due to processing such as the job ticket update and the like can be minimized.

(Other Embodiment)

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program, recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-107289, filed May 12, 2011, which is hereby incorporated by reference herein in its entirety.

What is claimed is:

1. An apparatus for controlling a plurality of jobs performed in a printer and a post-apparatus to produce a book including a plurality of parts, the apparatus comprising:

a receiving unit configured to receive information on an error that is caused in the printer or the post-apparatus;

a determination unit configured to determine whether or not reprinting of the part is necessary on the basis of the received error information; and an informing unit configured to inform the printer and the post-apparatus of change in the job order of the part for which it is determined that the reprinting is necessary and change in the job order of another part that constitutes the same book as the part for which it is determined that the reprinting is necessary.

2. The apparatus according to claim 1, wherein the changed job order for the part for which it is determined the reprinting being necessary is the same as the changed job order for another part that constitutes the same book as the part for which it is determined the reprinting being necessary.

3. The apparatus according to claim 1, wherein the informing unit, in a case that printing process of the another part that constitutes the same book as the part to be reprinted is finished, transmits information for promoting change in the processing order of the part for which printing process is finished, to the post-apparatus.

4. The apparatus according to claim 1, wherein the error information received by the receiving unit is manually input from an operator to the post-apparatus.

5. The apparatus according to claim 1, further comprising a generating unit configured to generate again a printing job of the part for which it is determined that the reprinting is necessary.

6. The apparatus according to claim 1, further comprising an identifying unit configured to identify a process in which the part for which it is determined that the reprinting is necessary merges with another part that constitutes the same book as the part for which it is determined that the reprinting is necessary, wherein the informing unit informs the printer and the post-apparatus of change in the job order of the another part that constitutes the same book as the part for which it is determined that the reprinting is necessary, in the identified process and the subsequent process.

7. A system that comprises an information processor, a printer and a post-apparatus controller and controls a plurality of jobs performed in the printer and the post-apparatus to produce a book including a plurality of parts, wherein the information processor includes:

a unit configured to receive information on an error that is caused in the printer or the post-apparatus;

a unit configured to determine whether or not reprinting of the part is necessary on the basis of the received error information; and a unit configured to inform the printer and the post-apparatus of change in the job order of the part for which it is determined that the reprinting is necessary and change in the job order of another part that constitutes the same book as the part for which it is determined that the reprinting is necessary.

8. A method performed by an apparatus that controls a plurality of jobs performed in a printer and a post-apparatus to produce a book including a plurality of parts, the method comprising:

a step of receiving information on an error that is caused in the printer or the post-apparatus;

a step of determining whether or not reprinting of the part is necessary on the basis of the received error information; and a step of informing the printer and the post-apparatus of change in the job order of the part for which it is determined that the reprinting is necessary and change in the job order of another part that constitutes the same book as the part for which it is determined that the reprinting is necessary.

9. A computer-readable recording medium having computer-executable instructions for performing a method performed by an apparatus that controls a plurality of jobs performed in a printer and a post-apparatus to produce a book including a plurality of parts, the method comprising:

a step of receiving information on an error that is caused in the printer or the post-apparatus;

a step of determining whether or not reprinting of the part is necessary on the basis of the received error information; and a step of informing the printer and the post-apparatus of change in the job order of the part for which it is determined that the reprinting is necessary and change in the job order of another part that constitutes the same book as the part for which it is determined that the reprinting is necessary.

* * * * *